US011519699B1

(12) United States Patent
Kissinger

(10) Patent No.: US 11,519,699 B1
(45) Date of Patent: Dec. 6, 2022

(54) INTERLOCKING RIOT SHIELD

(71) Applicant: Brandon L. D. Kissinger, Redmond, WA (US)

(72) Inventor: Brandon L. D. Kissinger, Redmond, WA (US)

( * ) Notice: Subject to any disclaimer, the term of this patent is extended or adjusted under 35 U.S.C. 154(b) by 0 days.

(21) Appl. No.: 17/213,323

(22) Filed: Mar. 26, 2021

(51) Int. Cl.

| | |
|---|---|
| ***F41H 5/08*** | (2006.01) |
| ***F21V 23/04*** | (2006.01) |
| ***F21S 9/02*** | (2006.01) |
| ***F41H 13/00*** | (2006.01) |

(52) U.S. Cl.
CPC ..... *F41H 5/08* (2013.01); *F21S 9/02* (2013.01); *F21V 23/04* (2013.01); *F41H 13/0087* (2013.01)

(58) Field of Classification Search
CPC ..... F41H 5/08
See application file for complete search history.

(56) References Cited

U.S. PATENT DOCUMENTS

| | | | | |
|---|---|---|---|---|
| 4,843,947 | A | 7/1989 | Bauer et al. | |
| 5,377,577 | A | 1/1995 | Bounkong et al. | |
| 6,367,363 | B1 | 4/2002 | Widmont | |
| 6,367,943 | B1 | 4/2002 | Tocci et al. | |
| 7,424,844 | B2 | 9/2008 | Carter | |
| 9,267,754 | B2 | 2/2016 | Seabrook | |
| 10,539,400 | B1 | 1/2020 | Nibert et al. | |
| 2009/0284957 | A1* | 11/2009 | Shemwell | F41H 13/00 362/109 |
| 2009/0284961 | A1* | 11/2009 | Shemwell | F41H 13/00 362/108 |
| 2010/0083820 | A1* | 4/2010 | Doyner | F41H 5/08 89/36.02 |
| 2015/0233679 | A1* | 8/2015 | Seabrook | F41A 27/10 89/36.07 |
| 2018/0073841 | A1* | 3/2018 | DeKort | F41H 5/08 |
| 2018/0128578 | A1* | 5/2018 | Huggins | F41H 13/0025 |
| 2019/0145741 | A1* | 5/2019 | Spransy | F41H 5/013 89/36.05 |

FOREIGN PATENT DOCUMENTS

| | | | | |
|---|---|---|---|---|
| GB | 2457757 A | * | 9/2009 | F41H 5/08 |
| GB | 2463454 A | * | 3/2010 | F41H 5/08 |
| JP | 07294197 A | * | 11/1995 | F41H 5/08 |

OTHER PUBLICATIONS

Transparent Interlocking Riot Shield—LONG—1200mm x 500mm. Product Listing [online]. Copyright © 2020, Firestorm Kit [retrieved on Jul. 8, 2020]. Retrieved from the Internet: <URL: https://www.firestomnkit.co.uk/index.php?route=product/product&product_id=2971>.

Police protective Interlocking Riot Shield price. Product Listing [online]. © 1999-2021 Alibaba.com. [retrieved on Jul. 8, 2020]. Retrieved from the Internet: <URL: https://www.alibaba.com/product-detail/Police-protective-Interlocking-Riot-Shield-price_60548917162.html>.

* cited by examiner

*Primary Examiner* — Alexander K Garlen
(74) *Attorney, Agent, or Firm* — Cramer Patent & Design, PLLC; Aaron R. Cramer

(57) ABSTRACT

An interlocking riot shield comprises a traditional riot shield having a pair female spring-loaded locks on a first shield vertical edge and a pair of male spring-loaded locks on a second shield vertical edge. Each riot shield is configured to join to an identical riot shield when the male edge interacts with the female edge. A pair of interlocked riot shields may be disengaged by means of the spring-loaded mechanism.

11 Claims, 4 Drawing Sheets

INTERLOCKING RIOT SHIELD

RELATED APPLICATIONS

None.

FIELD OF THE INVENTION

The presently disclosed subject matter is directed to a riot shield and more specifically to an interlocking riot shield.

BACKGROUND OF THE INVENTION

Recent events in our world's history have reminded us how easily large-scale civil disturbances can erupt at anytime and anywhere. When law enforcement officials arrive on the scene, one of the first tools they utilize is the riot shield. Basically, unchanged since ancient times, such shields provide physical protection for the officer from physical blows, thrown objects, and even hazardous liquids thrown at the officers. During use, the officers form a line with the shields forming a wall of protection.

However, should one officer become incapacitated, the wall can become easily breached allowing rioters on the other side of the line, often with disastrous results. Rioters often target the areas between shields when trying to break through such lines to create havoc and disruption. Accordingly, there exists a need for a means by which junctions between multiple riot shields can be enhanced. The development of the interlocking riot shield fulfills this need.

SUMMARY OF THE INVENTION

The principles of the present invention provide for an interlocking riot shield comprises a main body having a first side and a second side, a lighting system which is disposed on the main body, a view window which is centrally disposed on the main body, a weapons port which is disposed on the main body below the view window, a handle and an adjustable strap which is adapted to enable a law enforcement personnel to carry the interlocking riot shield with a pair of hands, a rechargeable battery pack which is disposed on the same side as the handle and an adjustable strap, an operating switch which activates the lighting system is in electrical communication between the battery pack and the lighting system, a supplemental ballistic protection which is disposed on one or more areas of the main body, and a plurality of attachment systems which is disposed on the main body or the supplemental ballistic protection. The lighting system is adapted to provide a user of the interlocking riot shield illumination for use in low light conditions. The pair of hands includes a firsthand and a second hand.

The lighting system may be placed in a strobe mode to incapacitate one or more unlawful individuals. The view window may be made of a ballistic proof material. The weapons port may be adapted to fire a weapon through the main body. The weapons port may be sited to remain accessible when the law enforcement personnel is using the interlocking riot shield where a forearm is looped through the adjustable strap while gripping the handle. The handle may be adapted to have the forearm looped through the adjustable strap while a hand of the forearm grips the handle. The handle may be adapted to have a firsthand on the handle and a second hand on the adjustable strap. The adjustable strap may include a securing buckle. The adjustable strap and the handle may be disposed on the first side or the second side. The operating switch includes an ON/OFF/STROBE position that may allow for supplemental illumination, de-energization, or incapacitating strobe light features.

The operating switch may be located adjacent the handle for ease in operation. The operating switch may be located adjacent the adjustable strap for ease in operation. The supplemental ballistic protection may be made of a plurality of ceramic plates. The supplemental ballistic protection may be made of a plurality of metal plates. The attachment systems include Modular Lightweight Load-carrying Equipment. The interlocking riot shield may be coupled with another interlocking riot shield to provide a more impenetrable line of protection to withstand physical impact and thrown objects.

The interlocking riot shield may be coupled in an S-shaped latch connection. The interlocking riot shield may be made of light-weight material. The interlocking riot shield may be made of durable material. The durable material may be selected from the group consisting of Kevlar, steel, or aluminum.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
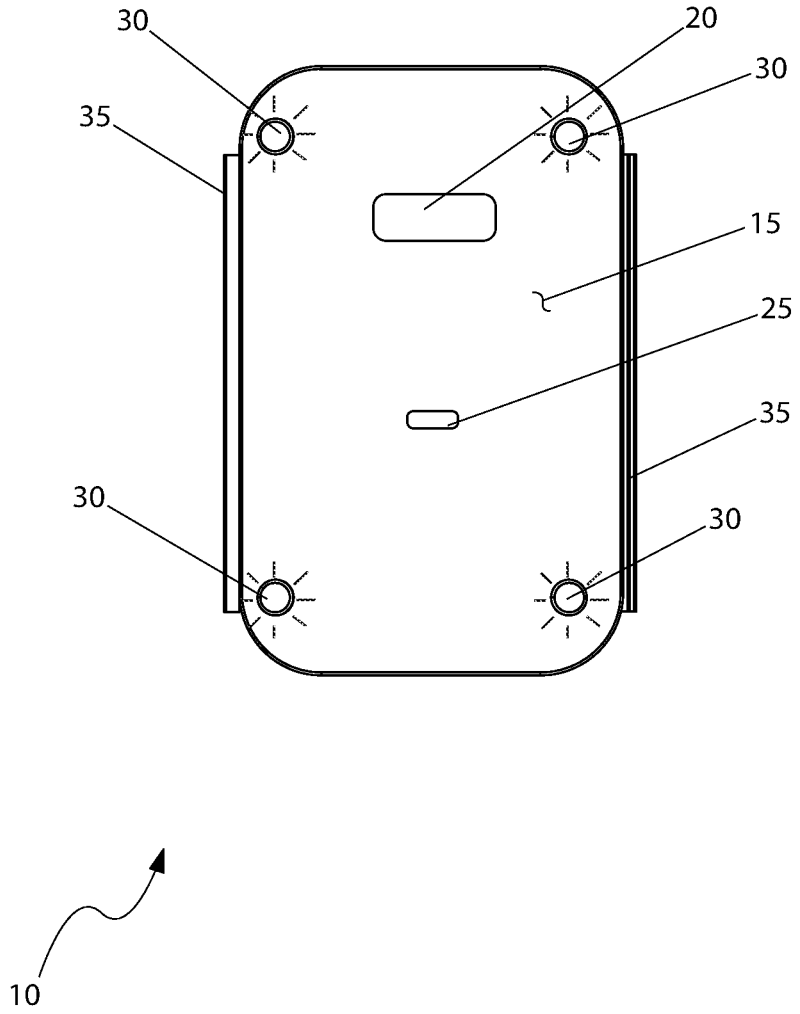
FIG. 1 is a front view of the interlocking riot shield, according to the preferred embodiment of the present invention.

10 interlocking riot shield
15 main body
20 view window
25 weapons port
30 lighting system
35 coupling system
40 handle
41 adjustable strap
45 rechargeable battery pack
50 operating switch
55*a* upper supplemental ballistic protection
55*b* lower supplemental ballistic protection
60*a* upper attachment system
60*b* lower attachment system

65 first mating surface
70 second mating surface
75 "S"-shaped latch connection
80 law enforcement personnel

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a front view of the interlocking riot shield 10, according to the preferred embodiment of the present invention is disclosed. The interlocking riot shield 10 (herein also described as the "shield") 10, includes an otherwise conventional riot shield provided with operational enhancements and the ability to be physically coupled to adjacent riot shields to provide a more impenetrable line of protection to withstand physical impact and thrown objects. The shield 10 is manufactured of a durable material such as Kevlar, steel, aluminum, or the like, capable of durability and ballistic protection, while maintaining a light weight, enabling a law enforcement personnel 80 to carry and deploy the shield 10 for extended periods of time.

In an exemplary embodiment, the approximate size of the invention would be thirty inches (30 in.) wide and four feet (4 ft.) tall. However, the materials used and the dimensions provided are in the preferred embodiment and are not intended to limit the scope of the present invention. A view window 20 is centrally located and is made of a ballistic proof material. A weapons port 25 is centrally located below the view window 20 and allows for firing of a weapon through the shield 10 by the carrying law enforcement personnel 80. A lighting system 30 provides the user of the shield 10 forward facing illumination for use in low light conditions. The lighting system 30 may also be placed in a strobe mode to serve to incapacitate unlawful individuals. Operation of the lighting system 30 will be described in greater detail herein below. The vertical sides of the shield 10 are provided with a coupling system 35 which will be described in greater detail herein below.

Figure 2:
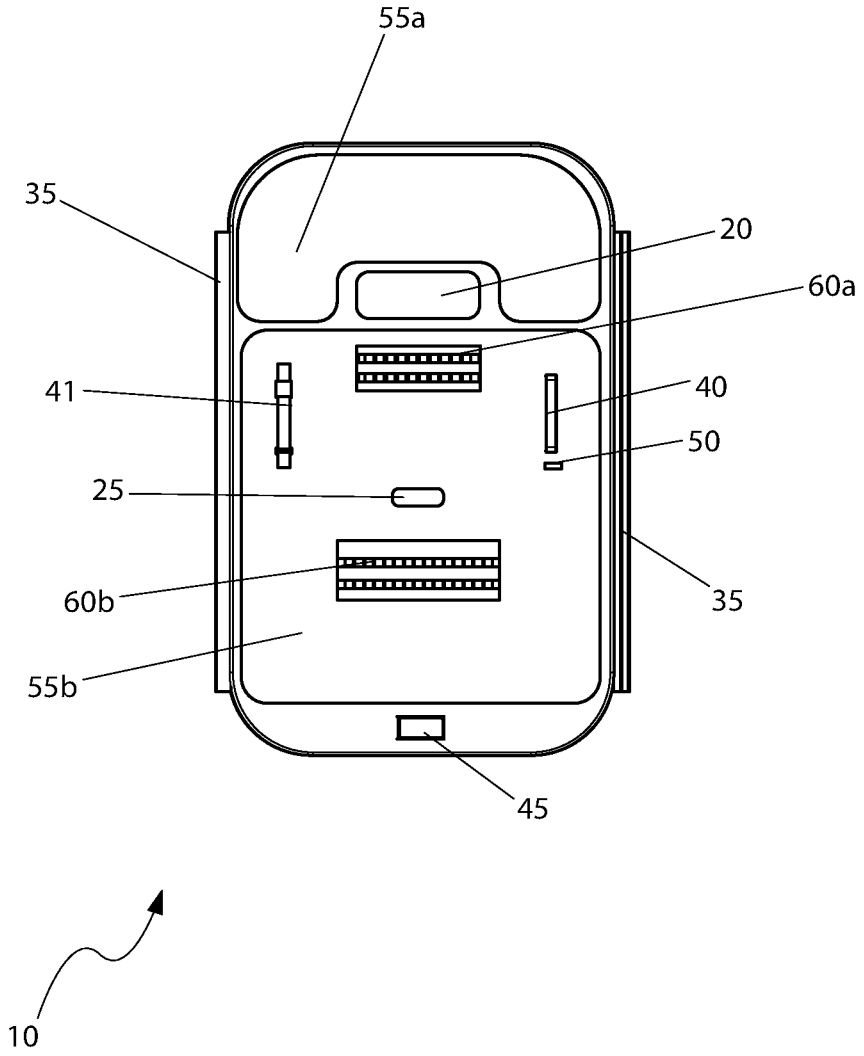
FIG. 2 is a rear view of the interlocking riot shield, according to the preferred embodiment of the present invention

Referring next to FIG. 2, a rear view of the shield 10, according to the preferred embodiment of the present invention is depicted. The view window 20 and the weapons port 25 remain visible on the rear side of the shield 10. A handle 40 and an adjustable strap 41 are present to enable the law enforcement personnel 80 to carry with two (2) hands (i.e., a first hand on the handle 40 and a second hand on the adjustable strap 41) or one (1) arm (a forearm looped through the adjustable strap 41 while a hand of the same forearm grips the handle 40). It is appreciated that the adjustable strap 41 can have a securing buckle or other securing means. It is also appreciated that the adjustable strap 41 and handle 40 can be located on either side of the view window 20 (i.e., left or right side) as desired for left-handed or right-handed wielding as desired by the user. The weapons port 25 is sited in such a manner so as to remain accessible when the law enforcement personnel 80 is using the shield 10 where the forearm is looped through the adjustable strap 41 and gripping the handle 40.

A rechargeable battery pack 45 is provided in an easily accessible location on the shield 10. An operating switch 50 for activation of the lighting system 30 (as shown in FIG. 1) is in electrical communication between the battery pack 45 and the lighting system 30. Due to the elevated weight of the battery pack 45, it is preferred that it is sited at a lower central position on the shield 10 and to provide a counterweight for the other features of the shield 10, thereby providing a balanced center of gravity when manipulated by a law enforcement personnel 10. The operating switch 50 is envisioned to have an ON/OFF/STROBE position to allow for supplemental illumination, de-energization, or incapacitating strobe light feature of the lighting system 30, as aforementioned described. Preferably, the operating switch 50 is located adjacent the handle 40 or alternately the adjustable strap 41 for ease in operation.

Supplemental ballistic protection 55*a*, 55*b* may be positioned on various areas of the main body 15. The supplemental ballistic protection 55*a*, 55*b* is envisioned to be made of a plurality of ceramic plates, metal plates or the like, and are envisioned to provide ballistic protection for up to a 12-gauge slug. The exact size, style, quantity, and material of the supplemental ballistic protection 55*a*, 55*b* is not intended to be a limiting factor of the present invention. In a preferred embodiment, the supplemental ballistic protection 55*a*, 55*b* is provided in two (2) disparate locations: upper supplemental ballistic protection 55*a* and lower supplemental ballistic protection 55*b* and are arranged so as to not interfere with the view window 20 or the weapons port 25 and to be placed to be coextensive with, or almost coextensive with, the width of the main body 15.

Attachment systems 60*a*, 60*b* such as the Modular Lightweight Load-carrying Equipment (MOLLE), may be provided directly on the main body 15 or attached over the supplemental ballistic protection 55*a*, 55*b*. The attachment system 60*a*, 60*b* may be used to attach various items, including, but not limited to: additional firearm magazines, smoke grenades, radios, knives, tasers, batons, canteen carriers, first-aid kits, sustainment food pouches, holsters, flashlights, handcuffs, or the like. In a preferred embodiment, the attachment system 60*a*, 60*b* is provided in two (2) disparate locations: upper attachment system 60*a* and lower attachment system 60*b* and are arranged so as to not interfere with the view window 20, the weapons port 25, or to not be covered by an arm or hand of the law enforcement personnel 80 when grasping the shield 10.

Figure 3:
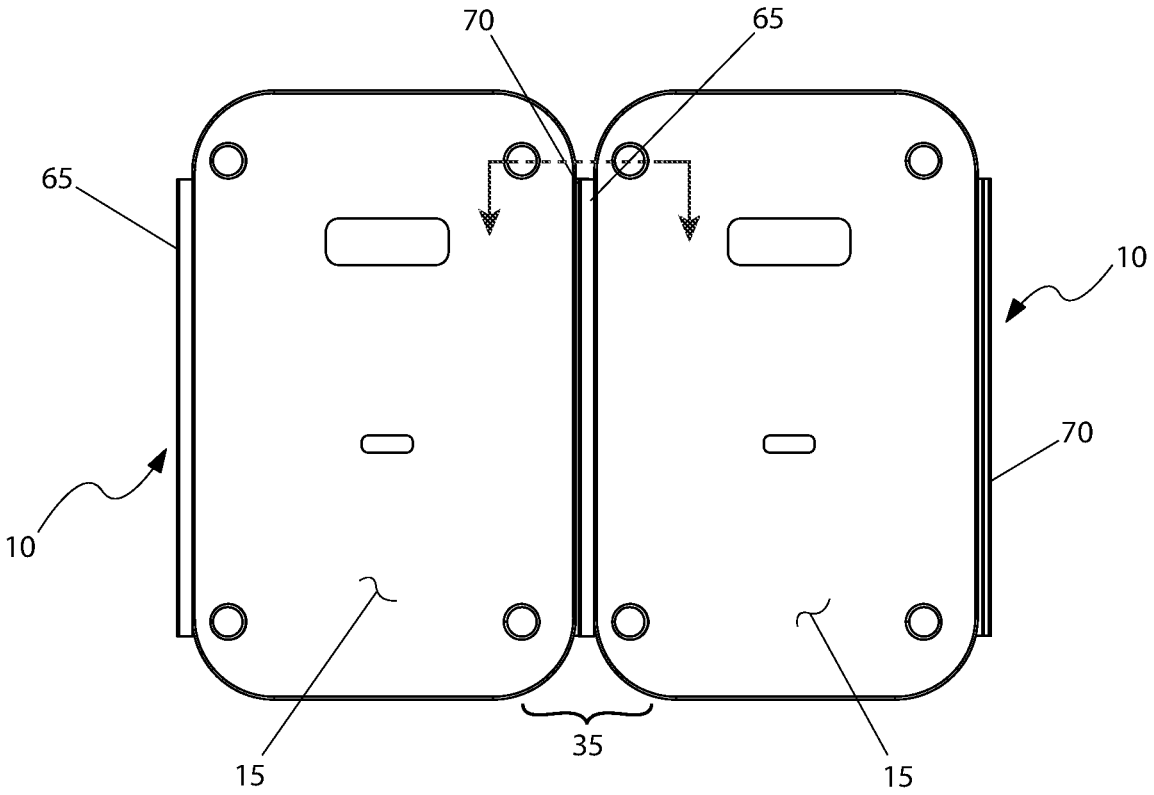
FIG. 3 is a front view of two (2) interlocking riot shields, shown in a joined state, according to the preferred embodiment of the present invention.

Referring now to FIG. 3, a front view of two (2) joined shields 10, shown in a joined state, according to the preferred embodiment of the present invention is shown. This figure clearly depicts the method of operation of the coupling system 35. The coupling system 35 includes a first mating surface 65 on a first side of the main body 15 and a second mating surface 70 on the opposing second side of the main body 15. The first mating surface 65 and the second mating surface 70 interlock together in a "S"-shaped manner. The exact method of connection will be described in greater detail hereinbelow. It the connected state as shown in FIG. 3, the conjoined two (2) shields 10 provide for a more solid plane of protection and eliminates the potential for objects as well as unlawful citizens to penetrate the protection afforded by multiple shields 10.

Figure 4:
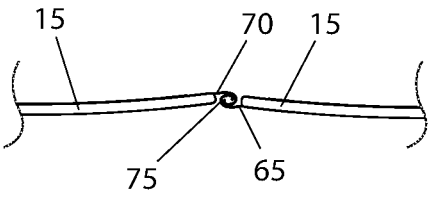
FIG. 4 is a sectional view of the two (2) joined interlocking riot shields, as seen along a Line I-I, as shown in FIG. 3, according to the preferred embodiment of the present invention.

Referring next to FIG. 4, a sectional view of the two (2) joined shields 10, as seen along a Line I-I, as shown in FIG. 3, according to the preferred embodiment of the present invention is disclosed. The first mating surface 65 and the second mating surface 70 are joined together by a "S"-shaped latch connection 75 which is continuous in nature for the entire length of the coupling system 35 (as shown in FIG. 1). The latch connections 75 interlock together and may joined by sliding from one (1) end or by simply folding the interlocking first mating surface 65 and second mating surface 70 together from a nearly parallel placement of both main body 15. The latch connection 75 allows for easy connection, but still allows for easy disconnection as well. The sliding nature of the latch connection 75 allows one (1) main body 15 to be elevated higher or lower than the adjacent user, but still maintain coupling. It is envisioned that the coupling system 35 has a tensile strength that biases the mating surfaces 65, 70 together to create the latch connection 75 together, and the coupling system 35 can be easily defeated by forcing the joined shields 10 together to compress the latch connection 75 to separate the mating surfaces 65, 70. Such a feature is envisioned as being valuable should the shield 10 be used by law enforcement officers of different heights.

Figure 5:
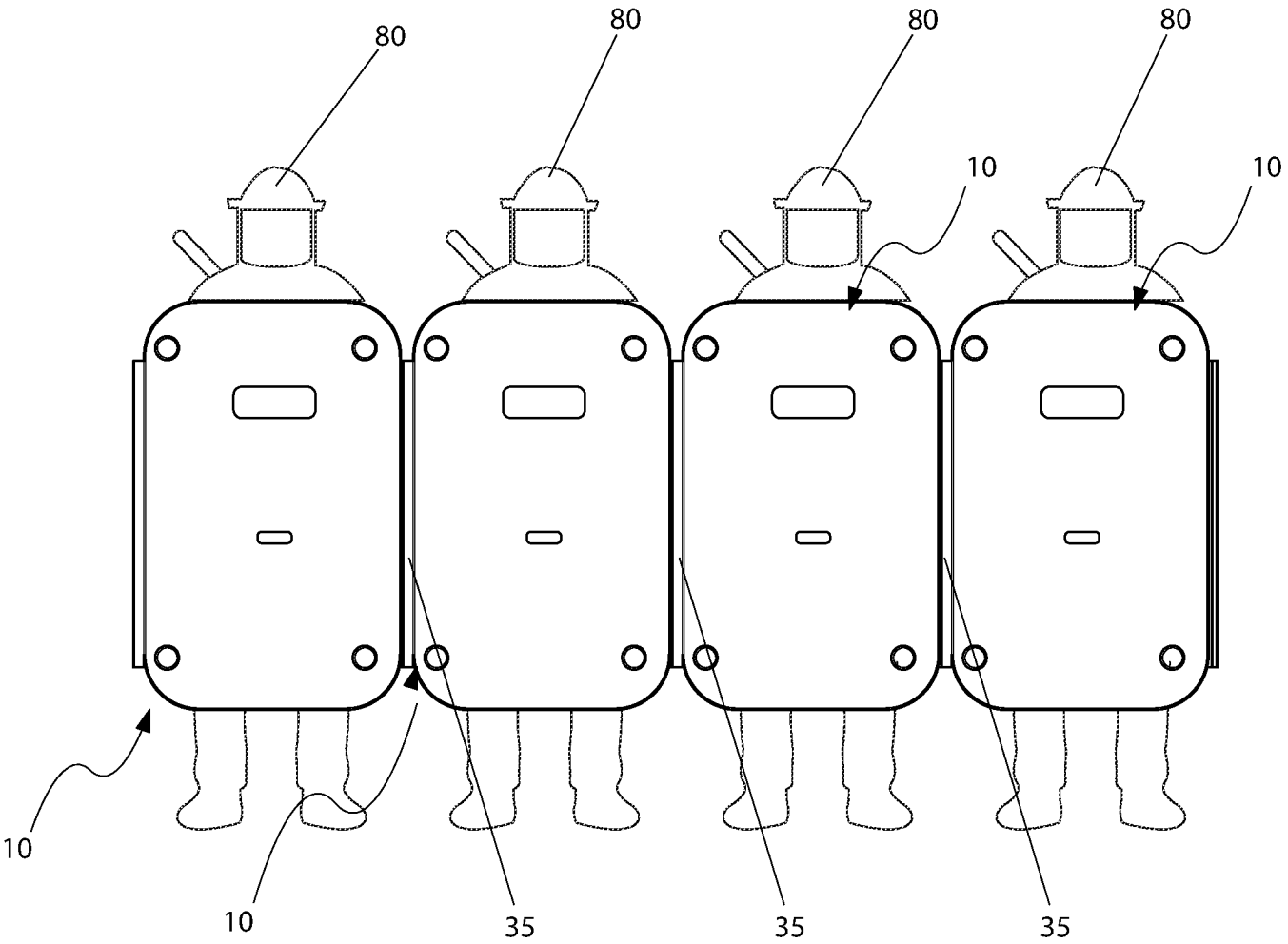
FIG. 5 is a pictorial view of the interlocking riot shield, shown in a utilized state, according to the preferred embodiment of the present invention.

Referring to FIG. 5, a pictorial view of the shield 10, shown in a utilized state, according to the preferred embodiment of the present invention is depicted. Multiple law enforcement personnel 80 are arranged in a linear manner as would be found when forming a barrier against unlawful protestors or rioters. Such an arrangement would also be used when driving said unlawful protestors or rioters backwards and/or preventing advancement. The shield 10 carried by each law enforcement personnel 80 is interlocked with its adjacent neighboring shield 10 using the coupling system 35. This arrangement allows for multiple shields 10, up to dozens or more, to be interlocked together. This allows multiple law enforcement personnel 80 to lock their shields 10 together into a nearly impenetrable wall to enhance their total physical protection even if a single law enforcement personnel 80 should become incapacitated and lose control of their shield, the protective barrier presented by the multiple shields 10 remains in place. While intended for interlocked usage as depicted in FIG. 5, the shield 10 may of course be used in an independent or solo manner as a conventional shield 10.

2. Operation of the Preferred Embodiment

The preferred embodiment of the present invention can be utilized by the common user in a simple and effortless manner with little or no training. It is envisioned that the shield 10 would be constructed in general accordance with FIG. 1 through FIG. 5. The law enforcement personnel 80 would procure the shield 10 from conventional procurement channels such as military suppliers, law enforcement equipment supply houses, mail order and internet supply houses and the like. Special attention would be paid to the overall size of the shield 10, material of construction, type of supplemental ballistic protection 55, type of lighting system 30, and the like.

After procurement and prior to utilization, the shield 10 would be prepared in the following manner: a first law enforcement personnel 80 would interlock their shield 10 with that of an adjacent law enforcement personnel 80 by interlocking or sliding the first mating surface 65 into the second mating surface 70; it would be ensured that the rechargeable battery pack 45 is completely charged, any necessary supplemental ballistic protection 55 is installed, and any user provided accessories are placed in the attachment system 60 if needed. At this point in time, the shield 10 is ready for utilization.

During utilization of the shield 10, the following procedure would be initiated: an individual law enforcement personnel 80 will hold his or her respective shield 10 in place by grasping the handle 40 with a first hand and the adjustable strap 41 with a second hand or alternately, looping a forearm through the adjustable strap 41 and grasping the handle 40 with the hand of the same forearm; the shield 10 may be lifted to protect the head of the law enforcement personnel 80 while forward vision is afforded by the view window 20; any lethal or non-lethal weapons may be discharged through the weapons port 25; the activation of the lighting system 30 is accomplished by manipulation of the operating switch 50, either to provide illumination via steady state operation of the lighting system 30 or in an incapacitating manner via strobe operation of the lighting system 30. Any attempt to penetrate the line of protection afforded by the joined shields 10 are thwarted by the strong junction of the coupling system 35 consisting of the interlocking nature of the first mating surface 65 and the second mating surface 70.

After use of the shield 10, it is uncoupled from any adjacent shield 10 by manipulation of the coupling system 35 into a near parallel orientation by compressing them together or by sliding the first mating surface 65 and the second mating surface 70 of the coupling system 35 completely apart. The shield 10 is then readied for use again in a repeating manner.

The features of the present invention allow for protection of law enforcement personnel 80 during times of civil unrest, helps to contain unlawful protestors or rioters, and aids in the restoration of law and order. The powerful image of multiple shields 10 interlocked together may serve to prevent the escalation of unwanted action on the part of the unlawful protestor or rioter. The invention would be ideal for use in police departments, national guards, federal agencies and the like, and may find application in military usage as well.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. An interlocking riot shield, comprising:

a main body having a first side and a second side;

a lighting system disposed on the main body, the lighting system is adapted to provide a user of the interlocking riot shield illumination for use in low light conditions;

a view window centrally disposed on the main body;

a weapons port disposed on the main body below the view window;

a handle and an adjustable strap adapted to enable a law enforcement personnel to carry the interlocking riot shield with a pair of hands, the pair of hands includes a first hand and a second hand;

a rechargeable battery pack disposed on the same side as the handle and an adjustable strap;

an operating switch activating the lighting system is in electrical communication between the battery pack and the lighting system;

a supplemental ballistic protection disposed on one or more areas of the main body; and a plurality of attachment systems disposed on the main body or the supplemental ballistic protection;

wherein the view window is made of a ballistic proof material;

wherein the weapons port is adapted to fire a weapon through the main body;

wherein the weapons port is sited to remain accessible when the law enforcement personnel is using the interlocking riot shield where a forearm is looped through the adjustable strap while gripping the handle;

wherein the handle is adapted to have the forearm looped through the adjustable strap while a hand of the forearm grips the handle;

wherein the handle is adapted to have a first hand on the handle and a second hand on the adjustable strap;

wherein the adjustable strap includes a securing buckle;

wherein the adjustable strap and the handle are disposed on the first side or the second side; and wherein the operating switch is located adjacent the adjustable strap for ease in operation.

2. The interlocking riot shield, according to claim 1, wherein the lighting system is placed in a strobe mode to incapacitate one or more unlawful individuals.

3. The interlocking riot shield, according to claim 1, wherein the operating switch includes an ON/OFF/STROBE position to allow for supplemental illumination, de-energization, or incapacitating strobe light features.

4. The interlocking riot shield, according to claim 1, wherein the supplemental ballistic protection is made of a plurality of ceramic plates.

5. The interlocking riot shield, according to claim 1, wherein the supplemental ballistic protection is made of a plurality of metal plates.

6. The interlocking riot shield, according to claim 1, wherein the attachment systems include Modular Light-weight Load-carrying Equipment.

7. The interlocking riot shield, according to claim 1, wherein the interlocking riot shield is coupled with another interlocking riot shield to provide a more impenetrable line of protection to withstand physical impact and thrown objects.

8. The interlocking riot shield, according to claim 1, wherein the interlocking riot shield is coupled in an S-shaped latch connection.

9. The interlocking riot shield, according to claim 1, wherein the interlocking riot shield is made of light-weight material.

10. The interlocking riot shield, according to claim 1, wherein the interlocking riot shield is made of durable material.

11. The interlocking riot shield, according to claim 10, wherein the durable material is selected from the group consisting of Kevlar, steel, or aluminum.

* * * * *